United States Patent [19]

Nilsson et al.

[11] 4,364,162

[45] Dec. 21, 1982

[54] PROCESS FOR THE AFTER-TREATMENT OF POWDER-METALLURGICALLY PRODUCED EXTRUDED TUBES

[75] Inventors: Peter Nilsson, Åby; Christer Åslund, Torshälla, both of Sweden

[73] Assignee: Granges Nyby AB, Nybybruk, Sweden

[21] Appl. No.: 73,070

[22] Filed: Sep. 6, 1979

[30] Foreign Application Priority Data

Sep. 6, 1978 [DE] Fed. Rep. of Germany ..... 2838850
Oct. 26, 1978 [DE] Fed. Rep. of Germany ..... 2846658

[51] Int. Cl.[3] ..... B22F 3/24

[52] U.S. Cl. ..... 419/26; 29/DIG. 31; 29/DIG. 47; 419/42; 419/45; 419/41

[58] Field of Search ..... 29/420, 420.5, 420, 29/DIG. 47, DIG. 31, 423, 424; 75/214, 226

[56] References Cited

U.S. PATENT DOCUMENTS

| | | | |
|---|---|---|---|
| 3,631,583 | 1/1977 | Haller | 29/420.5 |
| 3,657,803 | 4/1972 | Krock et al. | 29/DIG. 47 |
| 3,657,804 | 4/1972 | Krock et al. | 29/DIG. 47 |
| 3,922,769 | 12/1975 | Brenan | 29/420.5 |
| 3,939,241 | 2/1976 | Powell et al. | 29/420.5 |
| 4,050,143 | 9/1977 | Aslund | 29/420.5 |

FOREIGN PATENT DOCUMENTS

| | | | |
|---|---|---|---|
| 924069 | 4/1973 | Canada | 29/420 |
| 2419014 | 4/1974 | Fed. Rep. of Germany | . |

*Primary Examiner*—Francis S. Husar
*Assistant Examiner*—V. K. Rising
*Attorney, Agent, or Firm*—Antonelli, Terry & Wands

[57] ABSTRACT

A process for the after-treatment of powder-metallurgically produced extruded tubes of stainless steel or highly alloyed nickel steels, pressings initially being produced by introducing into a capsule of thin sheet steel a powder consisting predominantly of spherical particles which have been produced from the required starting material by sputtering and, after the capsule has been closed, the density of the powder is increased to at least about 80% to about 93% of the theoretical density by cold isostatic pressing and the pressings obtained are then extruded into tubes at temperatures around 1200° C. using glass as the lubricant and the extruded tubes still surrounded by the capsule are initially treated with aqueous sulphuric acid to remove the glass still present on their surface, subsequently cold-worked by drawing or reciprocating rolling and, after cold-working, are annealed in an oxidising atmosphere until the capsule has been converted into scale to such an extent that a surface free from capsule residues is obtained after pickling with mild pickles.

14 Claims, 1 Drawing Figure

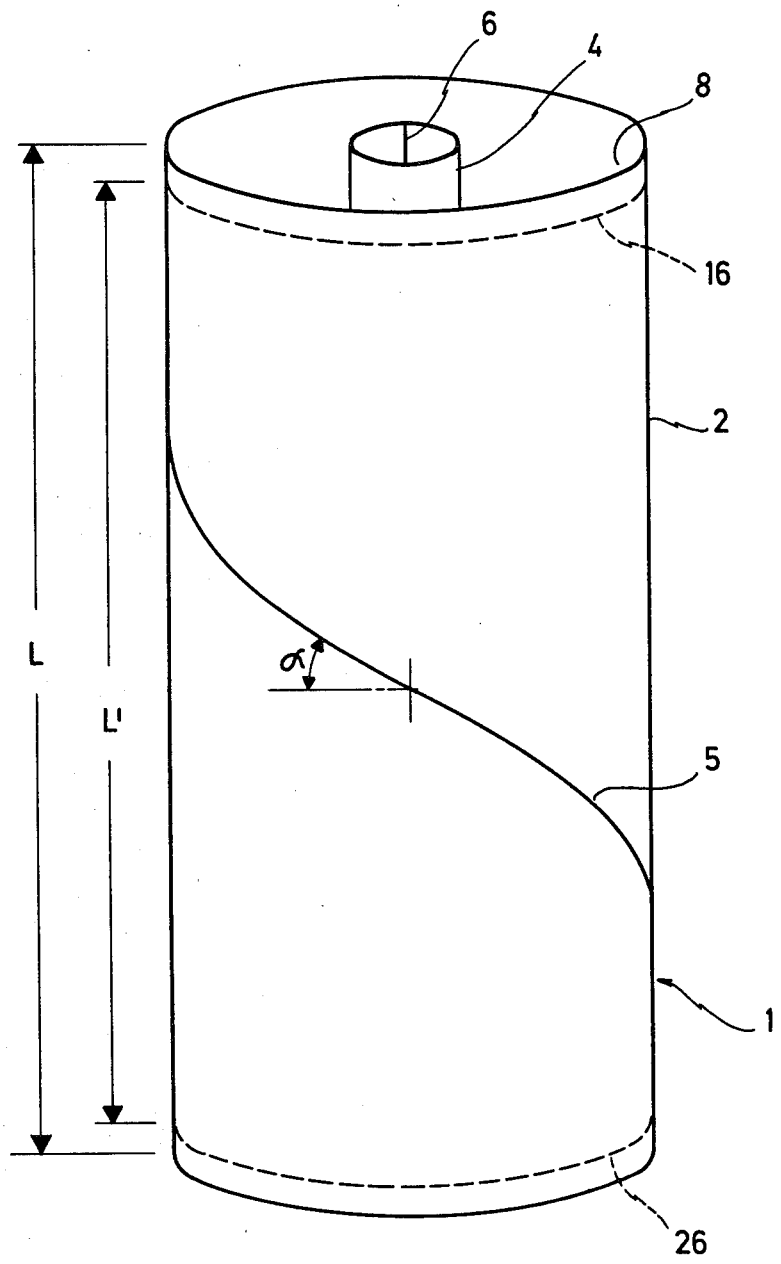
6
4
8
16
2
L
L'
α
5
1
26

PROCESS FOR THE AFTER-TREATMENT OF POWDER-METALLURGICALLY PRODUCED EXTRUDED TUBES

This invention relates to a process for the after-treatment of powder-metallurgically produced extruded tubes of stainless steel or highly alloyed nickel steels, particularly heat-resistant steels for heat exchangers, for example highly alloyed nickel steels or nickel alloys containing approximately 80% of nickel and approximately 20% of chromium, which have a uniform structure and uniform physical and chemical properties and a very good surface quality, the tubes being produced as follows: powder-form steel of the type in question is introduced into metallic capsules; the capsules are closed and compressed by a pressure acting on all sides thereof and the pressing obtained is extruded into tubes, steel powder of predominantly spherical particles produced by sputtering melt in an inert gas atmosphere being used and the capsules used being thin-walled capsules of a ductile metal having a maximum wall thickness corresponding to approximately 5% of the external diameter of the capsule; the density of the steel powder introduced into the capsule is increased to between about 60 and 70% of the theoretical density by vibration and/or ultrasound; the density of the steel powder being increased to at least 80% and preferably to between 80% and 93% of the theoretical density by isostatic cold-pressing of the capsule under a pressure of at least 1500 bars, preferably at least 4000 bars; the pressing is heated and subsequently hot extruded, preferably at temperatures of at least about 1200° C., to form the required semi-finished product.

According to German Offenlegungsschrift No. 2,419,014, it can be of advantage to evacuate the metallic capsules filled with the steel powder before they are closed and/or to fill them with a gas, particularly an inert gas, for example argon. In addition, according to German Offenlegungsschrift No. 2,-419,014, it is preferred to use metallic capsules of which the wall thickness amounts to less than 3% and more particularly to less than 1% of the external diameter of the capsule, metallic capsules having a wall thickness of from about 0.1 to 5 mm and preferably from about about 0.2 to 3 mm being particularly preferred.

According to German Offenlegungsschrift No. 2,419,014, it is also possible to produce composite tubes using thin-walled metallic capsules which are separated by one or more concentric partitions into two or more compartments. The predominantly spherical powder particles of the various steel qualities are respectively introduced under vibration into one of these compartments, after which the partitions are removed and the capsules closed, followed by isostatic cold pressing and extrusion at elevated temperature, For extruding the pressings into tubes, glass is normally used as the lubricant. The glass adheres to the surface of the extruded tube and is normally removed by treatment with hydrofluoric acid and nitric acid. In addition, the thin layer emanating from the capsule is simultaneously removed by the treatment with hydrofluoric acid and/or nitric acid. In addition, it has hitherto often been standard practice to heat-treat the extruded tube after extrusion and the above-mentioned acid treatment, the thin layer emanating from the capsule being removed by oxidation. Any residues of the layer emanating from the capsule are if necessary removed by sand blasting or by a similar treatment. Thereafter the extruded tubes completely freed from the capsule and residues thereof are normally further treated by cold drawing or reciprocating rolling in order to obtain a narrower cross-section and/or smaller wall thickness and/or better surfaces or the like.

The object of the present invention is to provide a process which simplifies the after-treatment of powder-metallurgically produced extruded tubes and improves their surface quality.

According to the invention, this object is achieved by a process for the aftertreatment of powder-metallurgically produced extruded tubes, particularly of stainless steel, in which pressings are intially produced using a thin-walled, metallic capsule, preferably a capsule consisting of a low-alloyed carbon steel, by cold isostatic pressing of the stainless steel powder and are subsequently extruded at elevated temperatures, preferably of at least about 1200° C., using glass as the lubricant into tubes having a dense structure, and which is characterised in that the extruded tubes still surrounded by the capsule are first treated with aqueous sulphuric acid in order to remove the glass still present on their surface, after which the extruded tubes are cold-worked by drawing or reciprocating rolling and are then annealed in an oxidising atmosphere, particularly air, to such an extent that the capsule is largely converted into scale and a high surface quality of the finished tubes is obtained by pickling with mild pickles.

The process according to the invention affords the advantage that the expensive and very complicated pickling of the extruded tubes before cold-working using strong hydrofluoric acid/nitric acid baths is replaced by pickling with aqueous sulphuric acid solution. The sulphuric acid solution is much easier to handle than the strong hydrofluoric acid/nitric acid pickles. The process according to the invention affords the further advantage that standard oils may be used for lubrication during the reciprocating rolling or drawing operation, whereas highly chlorinated oils normally have to be used for lubrication during reciprocating rolling or drawing when the thin layer emanating from the capsule is not present.

It has been found that the surface quality of the tubes obtained can be improved and the number of rejects and defective products can be reduced if at least the outer surface of the capsule has substantially the same strength properties in the axial direction over its entire circumference. To this end, a thin-walled, spiral-welded or extruded tube is preferably used, at least for the outer surface of the capsule. Forming the outer surface of the capsule in this way affords the advantage that extruded tubes characterised by a considerably reduced number of faults and, hence, rejects are obtained.

The pitch of the spirals formed by the weld seam in relation to the length of the capsule is preferably such that the weld seam approximately forms one complete turn. An outer surface provided with a weld seam such as this has only one weld seam at any point along its circumference in the axial direction and, therefore, shows substantially the same strength properties in the axial direction. Alternatively, the weld seam may form two, three or more complete turns.

The present invention is applicable to extruded tubes of, in particular, stainless steel or highly alloyed nickel steels, particularly heat-resistant steels for heat exchangers, for example highly alloyed nickel steels or nickel alloys containing approximately 80% of nickel and approximately 20% of chromium, powder of metal or metal alloys or mixtures thereof being introduced into the capsule. The powder used is preferably spherical or predominantly spherical powder having a mean particle diameter of preferably less than 1 mm. It is particularly preferred to use spherical powder which has been produced from the required starting material, i.e. the required metal and/or metal alloy, by sputtering in an inert gas atmosphere, preferably an argon atmosphere. It is preferred to use only powder particles having a diameter of up to about 1 mm and to separate particles having a diameter of larger than 1 mm, at least to a predominant extent, because argon is in danger of being included into powder particles having a diameter of larger than 1 mm. An inclusion of argon such as this can occur during sputtering, for example through turbulence. Any inclusion of argon would give rise during extrusion to unfavourable properties of the extruded articles and would lead to inclusion lines.

To produce the pressings for the tubes to be extruded, the capsule is advantageously filled with the powder, the density of the powder introduced into the capsule being increased by vibration to between about 60 and 71% of the theoretical density and the frequency of the vibration preferably amounting to at least about 70 Hz and advantageously to between 80 and 100 Hz. By vibration at a frequency of from 80 to 100 Hz, it is possible to obtain a density of from about 68 to 71% of the theoretical density.

After the powder has been introduced and compacted by vibration, the capsule is closed, preferably after evacuation and/or filling with an inert gas. Thereafter the density of the powder is increased to at least 80 to 93% of the theoretical density by isostatic cold pressing under a pressure of at least 4000 bars, preferably under a pressure of from 4200 to 6000 bars and, more particularly, under a pressure of from 4500 to 5000 bars.

Capsules of thin sheet iron, preferably about 1 to 3 mm thick sheet iron and, more particularly, about 1.5 mm thick sheet iron, have proved to be particularly advantageous. The material used for these capsules is preferably low-carbon iron, particularly iron having a carbon content of less than 0.015% and, better still, less than 0.004%, in order to prevent the powder from carburising during heating and extrusion.

Under the effect of the pressure applied on all sides during cold isostatic pressing, the capsule is uniformly compressed both in the longitudinal and in the radial direction and thus forms a pressing. This pressing should have no irregularities because this would give rise to difficulties during the extrusion of tubes.

In order to produce a pressing for extruding a tube, an annular capsule is used, the outer surface of this annular capsule being formed by a spiral-welded tube section produced for example from an approximately 1.5 mm thick sheet.

An inner wall, for example in the form of a longitudinally welded tube section, is introduced into the interior of the outer wall, having a smaller diameter than but the same wall thickness as the outer wall. An annular cover is then fixed between the outer wall and the inner wall at one end and the annular space between the two tubes is thus closed at one end. Spherical powder is then introduced into the annular space and compacted to around 68% of the theoretical density by vibration at a frequency of, for example, 80 Hz. A vacuum is then applied and the other end of the annular body is sealed off by a corresponding second cover. This is followed by cold isostatic pressing in a liquid, for example water, under a pressure of, for example, 4700 bars. Under the effect of the pressure applied on all sides, a pressing having a density of for example 88% of the theoretical density is obtained.

According to the invention, the spiral weld seam of the capsule is required to be as smooth as possible with as little effect as possible on the properties of the sheet iron. Accordingly, the weld seam is preferably smoothed by rolling and/or grinding. The smoothing of the weld seam by rolling may be carried out immediately after welding.

In the case of capsules for the production of tubes, it can be of advantage to produce not only the outer wall, but also the inner wall from a tube which has substantially the same strength properties in the axial direction along its circumference. In this case, the inner wall may consist either of a spiral-welded tube or of an extruded tube. The use of an extruded or spiral-welded tube for the inner wall is particularly advisable in the production of large tubes. In the production of smaller tubes, it is generally sufficient in accordance with the invention for the outer wall of the capsule to be produced from a tube section which has substantially the same strength properties in the axial direction along its circumference.

The process according to the invention affords the advantage that the surface of the tubes obtained is considerably better than in the known process. This is clearly attributable not only to the fact that the thin layer emanating from the capsule protects the surface of the tube during its cold working, but also to the fact that, where a capsule formed in accordance with the invention, in which at least the outer wall consists of an extruded or spiral-welded tube, is used, this layer is extremely homogeneous and facilitates the steady advance of the deformation zone occurring in a limited section over the cross-section during cold working in the longitudinal direction of the tubes, which would appear to be attributable to a type of tunnel effect which would also appear to contribute towards improving the surface quality.

Finally, the process according to the invention affords the advantage that not only the cross-section of the tube and/or its wall thickness, but also the thickness of the layer emanating from the capsule are reduced after cold working, so that this layer may readily be removed simply by annealing the cold-worked tubes for about 15 minutes in an oxidising atmosphere, particularly air, at a temperature of from about 1050° to 1100° C., bearing in mind that the cold-worked tubes generally have to be annealed in any case. Since the capsule is more or less completely converted into scale during annealing, it is possible in accordance with the invention for the subsequent pickling treatment to be carried out by brief immersion in very mild pickling baths, so that a very high surface quality is obtained and the danger of the steel of the tube being attacked is virtually eliminated.

In the process according to the invention, the warm sulphuric acid bath advantageously has a temperature of from 30° C. to 60° C., more particularly from 30° C. to 50° C. and, preferably, around 40° C., whilst the treatment time, i.e. the residence time of the extruded tubes in the warm sulphuric acid bath, is advantageously between about 10 and 40 minutes, more particularly between 10 and 30 minutes and, preferably, about 20 minutes at a treatment temperature of approximately 40° C. According to the invention, the aqueous sulphuric acid bath has a concentration of from about 8 to about 12% and preferably around 10%.

A two-stage pickling process using mild pickling baths is preferably used for pickling the tubes after they have been annealed. For example, an aqueous solution of 15 to 20% of HF is used in the first stage and an aqueous solution of from 15 to 20% of $HNO_3$ and 3 to 4% of HF in the second stage. The pickling baths preferably have a temperature of from about 55° to 60° C. After annealing, the tubes are preferably immersed for about 10 minutes in the first pickling bath and for about 3 to 8 minutes, more particularly for about 5 minutes, in the second pickling bath. The aqueous solution of the first pickling bath may additionally contain up to 10% and preferably from about 0.5 to 2.5% of NaCl.

An embodiment of the invention is described by way of example in the following with reference to the accompanying diagrammatic drawing which is an elevation of a capsule open at its upper end.

In the drawing, the capsule is generally denoted by the reference 1. The capsule has an outer wall 2 and an inner wall 4. The outer wall 2 consists of a spiral-welded tube section having a length L. The weld seam 5 extends spirally over the circumference of the outer wall 2, the spiral having a helix angle $\alpha$ such that the spiral forms approximately one complete turn.

It has been found to be of advantage to arrange the weld seam 5 in such a way that it forms one complete turn between the weld seam 16, which is used to weld the cover (not shown) of the capsule firmly to the outer wall 2, and the weld seam 26 by means of which the base of the capsule is joined to the outer wall. The distance between the weld seams 16 and 26 is denoted by the reference L' in the drawing. This length L' may be regarded as the effective length of the capsule. It is advisable to select the helix angle $\alpha$ of the spiral weld in such a way that $$tg\ \alpha = L'/n \cdot \pi \cdot D$$

where D is the diameter of the capsule and n the number of turns which the spiral weld seam 5 is required to comprise. It has been found to be advisable for n to have a value of 1. However, it may also be of advantage for n to have a value of 2, 3, 4 or to be equal to a larger whole number.

In the embodiment illustrated in the FIGURE, the inner wall 4 consists of a longitudinally welded tube section having a longitudinal weld seam 6.

The outer wall 2 and also the inner wall 4 of the capsule 1 consist of sheet iron having a carbon content of less than 0.004%. The cover which is not shown in the FIGURE is welded in along the weld seam 16. To produce the pressing, powder which consists predominantly of spherical particles having mean diameter of less than 1 mm and which has been produced from the required starting material, for example stainless steel, by sputtering in an argon atmosphere, is introduced into the capsule. After it has been introduced into the capsule, the powder is compacted to a density of, for example, approximately 68% of the theoretical density by vibration at a frequency of, for example, 80 Hz. The capsule is then evacuated and closed by means of the cover. The cover is directly joined to the outer wall 2 by welding substantially along the chain line 16. The powder is then compressed for example to around 88% of the theoretical density by isostatic cold pressing under a pressure of, for example, 4700 bars, so that a pressing is obtained.

In a test, a pressing was produced in the manner described above from powder which had been obtained by sputtering melt in argon and which consisted predominantly of spherical particles of stainless steel, the stainless steel powder being introduced into a 2.25 mm thick sheet steel capsule of low-alloyed carbon steel, converted into the pressing by cold isostatic pressing under a pressure of about 4700 bars and the pressing thus obtained extruded into a tube after it had been heated to around 1240° C. and lubricated with glass. The tube extruded from the pressing was immersed for 20 minutes in a sulphuric acid bath which has been heated to 40° C. and which has a sulphuric acid concentration of 10%. In this way, the remains of the glass used as lubricant were removed. The capsule was only attacked by the sulphuric acid bath to such an extent that only about 5% of its thickness was removed. Accordingly, around 95% of the capsule layer remained intact on the tube.

From the aligning process, the tubes passed directly to the cold reciprocating roll tube reducing machine operated under normal production conditions. The reduction in cross section amounted to approximately 70%, the reciprocating rolls being normally aligned. The layer thickness of the capsule material still remaining on the tube amounted to approximately 0.1 mm on the outer surface and to 0.02 mm on the inner surface. Thereafter the tubes were subjected to standard annealing in an oxidising atmosphere, i.e. air. Annealing for about 10 to 20 minutes at around 1050° to 1100° C. was sufficient to oxidise the thin layer of capsule material still present. After pickling in mild pickling baths, the tubes were completely free from capsule material and were characterised by a very high surface quality.

The pickling of the tubes after annealing was carried out by a pickling process using mild pickling baths. An aqueous solution of approximately 15% of HF was used in the first stage and an aqueous solution of approximately 20% of $HNO_3$, approximately 3% of HF and approximately 0.5 to 2.5% of NaCl in the second stage. The pickling baths had a temperature of around 60° C. and, after annealing, the tubes were immersed for about 5 to 15 minutes, preferably for about 10 minutes, in the first pickling bath and for about 3 to 8 minutes, preferably for about 5 minutes, in the second pickling bath.

Where a thin capsule is used, a very thin layer surrounding the extruded tube in a uniform thickness is obtained by the process according to the invention. It has surprisingly been found that this very thin layer may even be left on the extruded tube during the subsequent cold-working operation by drawing or reciprocating rolling, although it does become thinner during this operation.

In order to improve the flow properties during extrusion and cold working and to increase the yield of stainless or highly alloyed material, an annular insert of solid material may be provided at the front and/or rear end of the capsule. This annular insert, which may either be flat and plate-like or even spherical, hemi-spherical or funnel shaped, is provided with a central bore of which the internal diameter is substantially equal to the external diameter of the inner wall of the capsule. These annular inserts may be in the form of covers and bases closing the capsule at its ends and may be welded to the outer and inner walls of the capsule. The solid material of at least one insert remains at least partly connected to the tube during cold working where it preferably forms the frontmost section, and is used in particular for forming the drawing tangs.

During extrusion and cold forming, the insert at the front end of the capsule leads to a type of tunnel effect providing it is made of a ductile material, for example ductile iron, soft iron, low-alloyed carbon steel or cast iron. The pressure required in the container of the extrusion press for extruding the pressing is reduced where the front insert consists of ductile material which can be made to flow more easily than the powder filling of the pressing. Once the flow process taking place during extrusion has started, it also affects the powder filling, even when the yield point of the powder filling is higher than the yield point of the ductile material of the insert. Accordingly, a type of tunnel effect is obtained. Similarly, cold working, particularly cold drawing, is made easier if, as mentioned above, the frontmost section of the tube consists of a ductile material. In this case, too, a type of tunnel effect is obtained.

Since the inserts consist of a metal, preferably soft iron, which is more ductile than the powder-metallurgically produced stainless steel or highly alloyed nickel steel of which the tube itself consists and since, after extrusion of the tube, the material of the inserts forms a front and rear tube section which is separated from the rest of the tube by a more or less clear separating surface which acts as a pre-determined fracture zone, firm cohesion is generally not guaranteed. In order to improve this cohesion, the annular inserts may be provided towards the powder filling of the capsule with anchoring elements which preferably comprise undercuts and/or recesses and/or openings which preferably extend substantially perpendicularly of the capsule axis, are filled with the powder filling and, after extrusion, anchor the powder-metallurgically produced material with the inserts.

Since the extruded tube can be turned, it is sufficient for one of the inserts, preferably the insert serving as the base of the capsule, to be provided with the above-mentioned anchoring elements because the rear end of the extruded tube can form the front end of the tube during the cold-working operation.

We claim:

1. A process for the after-treatment of encapsulated powder-metallurgically produced extruded tubes of stainless steel or highly alloyed nickel steels produced, from pressings comprising a tubular capsule of thin, preferably 1 to 2 mm thick, low-carbon sheet steel preferably having a carbon content of less than 0.015% containing a powder of metal or metal alloys or mixtures thereof which after the capsule has been closed, has had its density increased to at least about 80% to about 93% of the theoretical density by isostatic cold pressing under a pressure of at least about 4000 bars, and then has been extruded at high temperatures, preferably around 1200° C., using glass as a lubricant, into tubes having a dense structure, comprising the steps of:

(a) removing glass present on the surface of the encapsulated extended tubes by means of aqueous sulphuric acid;

(b) subsequently cold-working the encapsulated tubes by one of cold drawing and reciprocating rolling;

(c) after step (b), annealing the encapsulated tubes in an oxidizing atmosphere in a manner converting the capsule to scale; and (d) pickling said tubes in a mild pickling liquid in a manner removing said scale.

2. A process according to claim 1, wherein the glass removing step is performed by immersing the extruded tubes in a warm sulphuric acid bath having a temperature of around 30° to 50° C. for between 10 to 30 minutes.

3. A process according to claim 2, wherein the temperature of said bath is approximately 40° C. and the extruded tubes are kept therein for approximately 20 minutes.

4. A process according to claim 1 or 3, wherein said pickling step is performed in two stages, an aqueous solution of approximately 15 to 20% of HF being used in a pickling bath as the pickling liquid in the first stage and an aqueous solution of approximately 15 to 20% of $HNO_3$ and approximately 3 to 4% of HF being used in a pickling bath as the pickling liquid in the second stage, the pickling baths preferably having a temperature of from about 55° to 60° C. and the tubes being immersed for about 5 to 15 minutes in the first bath and for about 3 to 8 minutes in the second bath.

5. A process as claimed in claim 1 or 3, characterised in that the aqueous sulphuric acid has a concentration of from about 8 to 12%, preferably around 10%.

6. A process according to claim 5, wherein said pickling step is performed in two stages, an aqueous solution of approximately 15 to 20% of HF being used in a pickling bath as the pickling liquid in the first stage and an aqueous solution of approximately 15 to 20% of $HNO_3$ and approximately 3 to 4% of HF being used in a pickling bath as the pickling liquid in the second stage, the pickling baths preferably having a temperature of from about 55° to 60° C. and the tubes being immersed for about 5 to 15 minutes in the first bath and for about 3 to 8 minutes in the second bath.

7. A process according to claim 6, wherein the tubes are immersed for 10 minutes in said first bath and 5 minutes in said second bath.

8. A process according to claim 4, wherein the tubes are immersed for 10 minutes in said first bath and 5 minutes in said second bath.

9. A process according to claim 4, wherein the cold-working step is performed by drawing.

10. A process according to claim 4, wherein said cold-working step is performed by reciprocating rolling.

11. A process according to claim 4, wherein said capsule is provided with an annular insert of solid material which is either flat and plate-like or even spherical, hemi-spherical or funnel-shaped at the front and/or rear end of the capsule, which serve as covers and bases closing the capsule at its ends and are welded to the outer and inner wall of the capsule, and wherein said cold-working step is performed with the solid material of at least one insert remaining at least partly connected to the tube as the frontmost section for the formation of drawing tangs.

12. A process according to claim 1 or 3, wherein the cold-working step is performed by drawing.

13. A process according to claim 1 or 3, wherein said cold-working step is performed by reciprocating rolling.

14. A process as claimed in claim 1, characterised in that the inserts consist of a metal, preferably soft iron, which is more ductile than the powder-metallurgically produced stainless steel or highly alloyed nickel steel of which the tube itself is made.

* * * * *